US007773057B2

(12) United States Patent
Choi et al.

(10) Patent No.: US 7,773,057 B2
(45) Date of Patent: Aug. 10, 2010

(54) DISPLAY DEVICE AND DRIVING METHOD THEREOF

(75) Inventors: Joon-Hoo Choi, Seoul (KR); Jong-Moo Huh, Hwaseong-si (KR); In-Su Joo, Seongnam-si (KR); Chun-Seok Ko, Hwaseong-si (KR); Beohm-Rock Choi, Seoul (KR)

(73) Assignee: Samsung Electronics Co., Ltd. (KR)

( * ) Notice: Subject to any disclaimer, the term of this patent is extended or adjusted under 35 U.S.C. 154(b) by 623 days.

(21) Appl. No.: 11/101,012

(22) Filed: Apr. 7, 2005

(65) Prior Publication Data

US 2005/0269958 A1 Dec. 8, 2005

(30) Foreign Application Priority Data

Apr. 7, 2004 (KR) ..... 10-2004-0023736

(51) Int. Cl.
*G09G 3/30* (2006.01)

(52) U.S. Cl. ..... 345/77; 345/76; 315/169.3

(58) Field of Classification Search ..... 345/76–90, 345/94, 55, 204, 99; 315/169.4, 169.3
See application file for complete search history.

(56) References Cited

U.S. PATENT DOCUMENTS 6,380,689 B1 * 4/2002 Okuda ..... 315/169.3
6,680,580 B1 * 1/2004 Sung ..... 315/169.3
6,731,276 B1 * 5/2004 Ishizuka ..... 345/211
6,750,833 B2 * 6/2004 Kasai ..... 345/76
6,958,750 B2 * 10/2005 Azami et al. ..... 345/204
7,167,169 B2 * 1/2007 Libsch et al. ..... 345/211
7,355,571 B2 * 4/2008 Yamada et al. ..... 345/76
7,355,572 B2 * 4/2008 Uchino et al. ..... 345/77
7,612,749 B2 * 11/2009 Libsch et al. ..... 345/82
2002/0050962 A1 5/2002 Kasai
2002/0195968 A1 * 12/2002 Sanford et al. ..... 315/169.3
2003/0011626 A1 1/2003 Tanabe
2003/0103022 A1 * 6/2003 Noguchi et al. ..... 345/77
2003/0137503 A1 * 7/2003 Kimura et al. ..... 345/212
2003/0160745 A1 * 8/2003 Osame et al. ..... 345/82
2003/0227262 A1 * 12/2003 Kwon ..... 315/169.3
2004/0007989 A1 * 1/2004 Li ..... 315/169.3
2004/0008252 A1 * 1/2004 Osame et al. ..... 348/131
2004/0027318 A1 2/2004 Kimura (Continued)

FOREIGN PATENT DOCUMENTS

JP 08054836 2/1996

(Continued)

*Primary Examiner*—Alexander Eisen
*Assistant Examiner*—Jason M Mandeville
(74) *Attorney, Agent, or Firm*—Cantor Colburn LLP

(57) ABSTRACT

A display device is provided, which includes: light emitting elements; switching transistors transmitting data signals in response to scanning signals; driving transistors, each driving transistor electrically connected to a driving signal line and one of the switching transistors and supplying a current to the light emitting elements in response to an output signal of the one of the switching transistors and the driving signal of the driving signal line; and a first capacitor electrically connected between each driving transistor and each driving signal line; and a second capacitor electrically connected between each light emitting element and each driving transistor, wherein the first and the second capacitors transmit the driving signal by capacitive coupling.

9 Claims, 3 Drawing Sheets

U.S. PATENT DOCUMENTS

| | | | | |
|---|---|---|---|---|
| 2004/0257353 | A1* | 12/2004 | Imamura et al. | 345/204 |
| 2005/0179625 | A1* | 8/2005 | Choi et al. | 345/76 |
| 2009/0184902 | A1* | 7/2009 | Tomida et al. | 345/77 |

FOREIGN PATENT DOCUMENTS

| | | | |
|---|---|---|---|
| JP | 2002207451 | | 7/2002 |
| JP | 2003271095 | | 9/2003 |
| JP | 2003-302936 | | 10/2003 |
| KR | 20010112310 | | 12/2001 |
| KR | 100335061 | | 4/2002 |
| KR | 1020030073116 | | 9/2003 |
| KR | 1020030078668 | | 10/2003 |
| KR | 1020040002726 | | 1/2004 |
| KR | 1020040005974 | | 1/2004 |
| WO | WO 03105117 | A2 * | 12/2003 |

* cited by examiner

DISPLAY DEVICE AND DRIVING METHOD THEREOF

This application claims priority to Korean Patent Application Nos. 10-2004-0023736, filed on Apr. 7, 2004, the contents of which in its entirety are herein incorporated by reference.

BACKGROUND OF THE INVENTION (a) Field of the Invention

The present invention relates to a display device and a driving method thereof. More particularly, the present invention relates to a light emitting display device and a driving method thereof.

(b) Description of Related Art

Recently there has been a trend toward production of lightweight and thin personal computers and television sets. To support the above-mentioned trend, lightweight and thin display devices are required. Flat panel displays are lightweight and thin in comparison to conventional cathode ray tubes (CRTs) and thus are widely being substituted for CRTs.

Examples of flat panel displays include a liquid crystal display (LCD), field emission display (FED), organic light emitting display (OLED), plasma display panel (PDP), and others.

Generally, an active matrix flat panel display includes a plurality of pixels arranged in a matrix. Active matrix flat panel displays display images by controlling a luminance of the pixels based on given luminance information. An OLED is a self-emissive display device that displays images by electrically exciting light emitting organic material. The OLED consumes less power than many other flat panel displays, and has a wide viewing angle and fast response time, thereby making the OLED advantageous for displaying moving images.

A pixel of the OLED includes a light emitting element and a driving thin film transistor (TFT). The light emitting element emits light having an intensity that varies in response to a current driven by the driving TFT, which in turn varies in response to a threshold voltage of the driving TFT and a voltage between gate and source of the driving TFT.

The driving TFT includes polysilicon or amorphous silicon. Although a polysilicon TFT has several advantages, disadvantages of the polysilicon TFT include a complexity of manufacturing polysilicon, which thereby increases manufacturing costs. In addition, it is difficult to make a large OLED employing polysilicon TFTs.

On the contrary, an amorphous silicon TFT is manufactured using fewer process steps than the polysilicon TFT. Thus, making a large OLED is easier to accomplish using amorphous silicon TFTs than using polysilicon TFTs. However, an OLED employing amorphous silicon TFTs exhibits a deterioration of bias stress stability. The deterioration of bias stress stability is indicated by a reduction of an output current of the amorphous silicon TFT over time during a long-time application of high DC control voltages with high driving voltages. The deterioration of bias stress stability causes a luminance of the OLED to be varied for a given data voltage.

SUMMARY OF THE INVENTION

The present invention solves the problems of conventional techniques.

A display device is provided, which includes: light emitting elements; switching transistors transmitting data signals in response to scanning signals; driving transistors, each driving transistor connected to a driving signal and one of the switching transistors and supplying a current to the light emitting elements in response to an output signal of the one of the switching transistors and a driving signal of the driving signal line; a first capacitor connected between each driving transistor and each driving signal line; and a second capacitor connected between each light emitting element and each driving transistor, wherein the first and the second capacitors transmit the driving signal by capacitive coupling.

The driving signal may have a plurality of voltage levels. One frame may be divided into at least two periods and the driving signal has voltage values corresponding to each of the at least two periods. The at least two periods may include: a first period for writing data voltages; a second period for emitting light; and a third period for applying a reverse bias to each driving transistor.

The driving signal may have a first voltage level to turn off each driving transistor, a second voltage level to turn on each driving transistor, and a third voltage level less than the first voltage level.

Each driving transistor may have a control terminal electrically connected to one of the switching transistors, an input terminal electrically connected to the driving signal line, and an output terminal electrically connected to the light emitting element, the first capacitor may be electrically connected between the control terminal and the input terminal of each driving transistor, and the second capacitor may be electrically connected between the control terminal and the output terminal of each driving transistor. Each one of the switching transistors and each driving transistor may include amorphous silicon or NMOS thin film transistors.

A display device is provided, which includes: a plurality of pixels, each pixel including a light emitting element and a driving transistor supplying a current to the light emitting element; a signal controller diving a frame into first to third periods and generating a control signal for instructing for the first to third periods; and a driving signal generator supplying a driving signal having a plurality of voltage levels in response to the control signals from the signal controller, wherein data voltages are written during the first period, the light emitting elements emit light based on the data signals during the second period, and the driving transistors are supplied with a reverse bias during the third period.

The driving signal may have first to third voltage levels different from each other in the first to the third periods, respectively. The first voltage level turns off the driving transistor, the second voltage level turns on the driving transistor; and the third voltage level may be less than the first voltage level.

Each pixel may further include first and second capacitors capacitively coupled to transmit the driving signal to the driving transistor. The display device may further include a data driver writing the data signals to the pixels.

A method of driving a display device including pixels, each pixel including a light emitting element and a driving transistor supplying a current to the light emitting element is provided. The method includes: writing data signals to the pixels during a first period; emitting light from the light emitting elements in response to the data signals during a second period; and applying a reverse bias to the driving transistor during a third period.

The driving transistor may be supplied with a driving signal having first to third voltage levels for the first to the third periods, respectively. The first voltage level turns off the driving transistor, the second voltage level turns on the driving transistor; and the third voltage level may be less than the first voltage level.

BRIEF DESCRIPTION OF THE DRAWINGS

The present invention will become more apparent by describing embodiments thereof in detail with reference to the accompanying drawing in which.

DETAILED DESCRIPTION OF THE INVENTION

Figure 1:
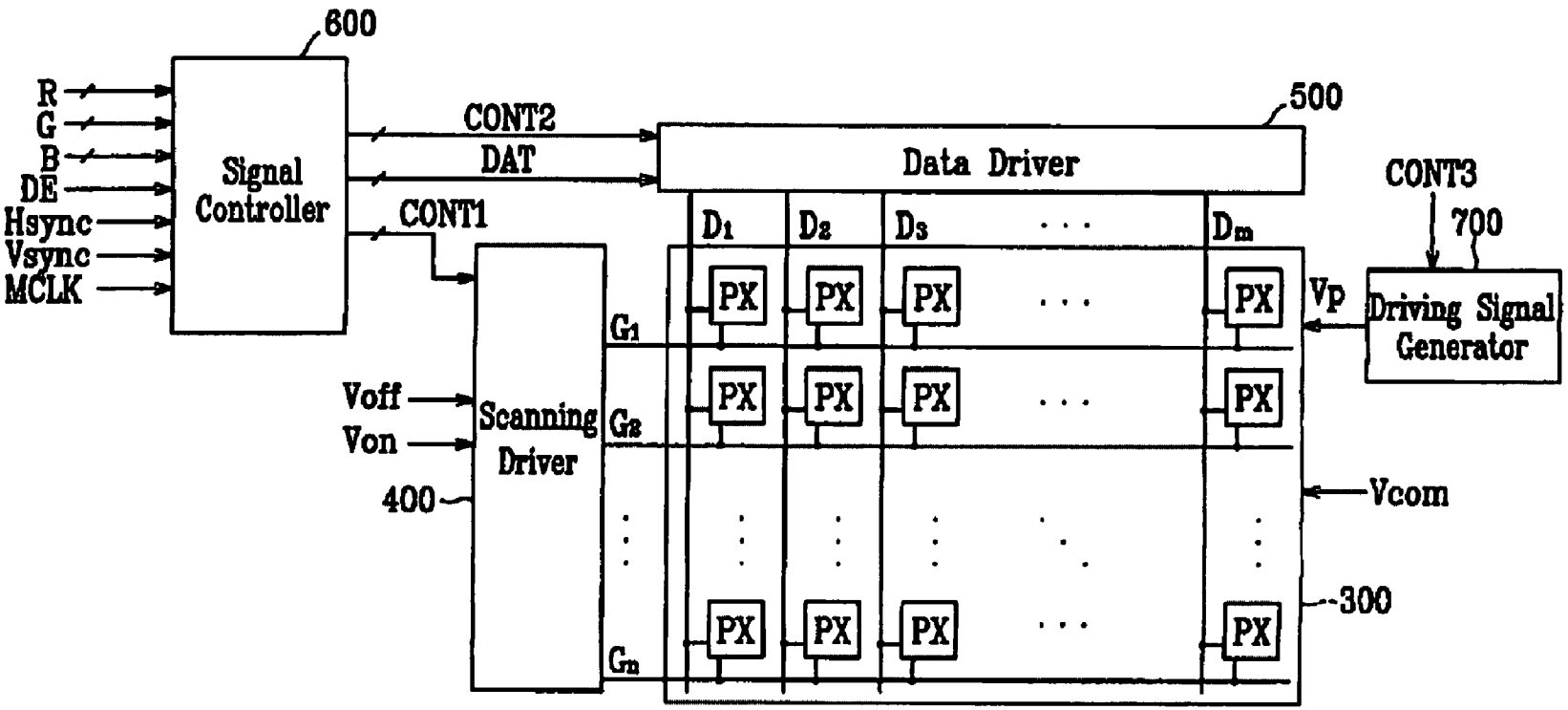
FIG. 1 is a block diagram of an OLED according to an exemplary embodiment of the present invention.

The present invention will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Figure 2:
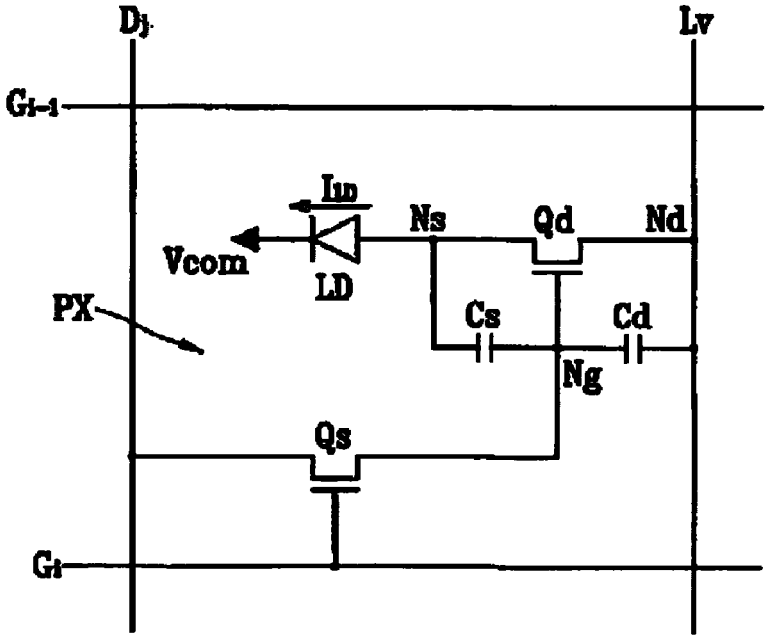
FIG. 2 is an equivalent circuit diagram of a pixel of an OLED according to an exemplary embodiment of the present invention.
Figure 3:
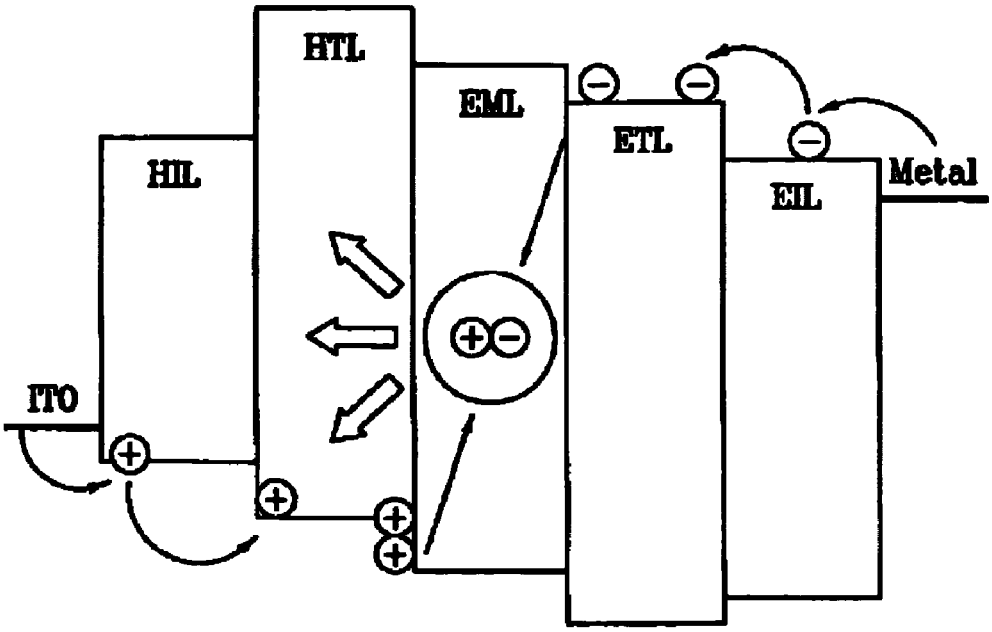
FIG. 3 is a schematic diagram of an organic light emitting element according to an exemplary embodiment of the present invention.

Referring to FIGS. 1-3, an organic light emitting display (OLED) according to an exemplary embodiment of the present invention will be described in detail.

FIG. 1 is a block diagram of an OLED according to an exemplary embodiment of the present invention. FIG. 2 is an equivalent circuit diagram of a pixel of an OLED according to an exemplary embodiment of the present invention. FIG. 3 is a schematic diagram of an organic light emitting element according to an exemplary embodiment of the present invention.

Referring to FIG. 1, an OLED according to this embodiment includes a display panel 300, drivers including a scanning driver 400, a data driver 500, and a driving signal generator 700 that are each connected to the display panel 300, and a signal controller 600 controlling the above elements.

Referring to FIG. 1, the display panel 300 includes signal lines and pixels PX connected to selected signal lines and arranged substantially in a matrix.

The signal lines include scanning lines $G_1$-$G_n$ transmitting scanning signals and data lines $D_1$-$D_m$ transmitting data signals. The scanning lines $G_1$-$G_n$ extend substantially in a row direction and are substantially parallel to each other, while the data lines $D_1$-$D_m$ extend substantially in a column direction and are substantially parallel to each other. The data signals may be voltage signals.

Referring to FIG. 2, the signal lines further include driving signal lines Lv transmitting a driving voltage signal Vp. Each pixel PX, for example, a pixel connected to a scanning line $G_i$ and a data line $D_j$, includes an organic light emitting element LD, a driving transistor Qd, a first capacitor Cs and a second capacitor Cd, and a switching transistor Qs.

The driving transistor Qd has a control terminal Ng electrically connected to the switching transistor Qs, an input terminal Nd electrically connected to a driving signal line Lv transmitting the driving voltage signal Vp, and an output terminal Ns electrically connected to the light emitting element LD.

The light emitting element LD includes an anode electrically connected to the output terminal Ns of the driving transistor Qd and a cathode electrically connected to a common voltage Vcom. The light emitting element LD emits light having an intensity that varies in response to an output current $I_{LD}$ of the driving transistor Qd. The output current $I_{LD}$ of the driving transistor Qd varies in response to a voltage Vgs between the control terminal Ng and the output terminal Ns of the driving transistor Qd.

Referring to FIG. 3, the light emitting element LD includes an organic light emitting member, and the anode and the cathode. The anode may be a transparent conductor such as indium tin oxide (ITO) or indium zinc oxide (IZO) and the cathode may be made of a metal layer. The organic light emitting member has a multilayered structure including an emitting layer EML and auxiliary layers for improving an efficiency of light emission of the emitting layer EML. The auxiliary layers include an electron transport layer ETL and a hole transport layer HTL for improving a balance of electrons and holes and an electron injecting layer EIL and a hole injecting layer HIL for improving an injection of the electrons and holes. The emitting layer EML emits light representing one of primary colors such as red, green, and blue.

The switching transistor Qs has a control terminal electrically connected to the scanning line $G_i$, an input terminal electrically connected to the data line $D_j$, and an output terminal electrically connected to the control terminal Ng of the driving transistor Qd. The switching transistor Qs transmits the data signal, for example, $Vd_j$, applied to the data line $D_j$ to the driving transistor Qd in response to a scanning signal $Vg_i$ applied to the scanning line $G_i$.

The switching transistor Qs and the driving transistor Qd are n-channel field effect transistors (FETs) including amorphous silicon or polysilicon. However, the switching and driving transistors Qs and Qd may be p-channel FETs operating in a manner opposite to n-channel FETs.

The second capacitor Cd is electrically connected between the control terminal Ng and the input terminal Nd of the driving transistor Qd and the first capacitor Cs is electrically connected between the control terminal Ng and the output terminal Ns of the driving transistor Qd. The first and second capacitors Cs and Cd store and maintain the data signal applied to the control terminal Ng of the driving transistor Qd. The first and second capacitors Cs and Cd are capacitively coupled to transmit a voltage change of the driving voltage signal Vp to the driving transistor Qd.

Referring to FIG. 1 again, the scanning driver 400 is electrically connected to the scanning lines $G_1$-$G_n$ of the display panel 300 and synthesizes a gate-on voltage Von for turning on the switching transistor Qs and a gate-off voltage Voff for turning off the switching transistor Qs to generate scanning signals for application to the scanning lines $G_1$-$G_n$. The data driver 500 is connected to the data lines $D_1$-$D_m$ of the display panel 300 and applies data signals to the data lines $D_1$-$D_m$.

The scanning driver 400 or the data driver 500 may be implemented as an integrated circuit (IC) chip mounted on the display panel 300 (i.e. chip on glass (COG) type) or as an IC mounted on a flexible printed circuit (FPC) film (i.e. tape carrier package (TCP) type), which is attached to the display panel 300. Alternatively, the scanning driver 400 or the data driver 500 may be integrated into the display panel 300 along with the scanning lines $G_1$-$G_n$ and the data lines $D_1$-$D_m$ and the driving and switching transistors Qd and Qs.

The driving signal generator 700 is connected to the driving signal lines Lv of the display panel 300 and generates the driving voltage signal Vp having a plurality of voltage levels for application to the driving signal lines Lv. In an exemplary embodiment, the driving voltage signal Vp includes three levels, i.e., a low level voltage VC, a middle level voltage VA, and a high level voltage VB (see FIG. 4).

The signal controller 600 controls the scanning driver 400, the data driver 500, and the driving signal generator 700.

Operation of the above-described OLED will now be described in detail with reference to FIGS. 1, 4 and 5.

Figure 4:
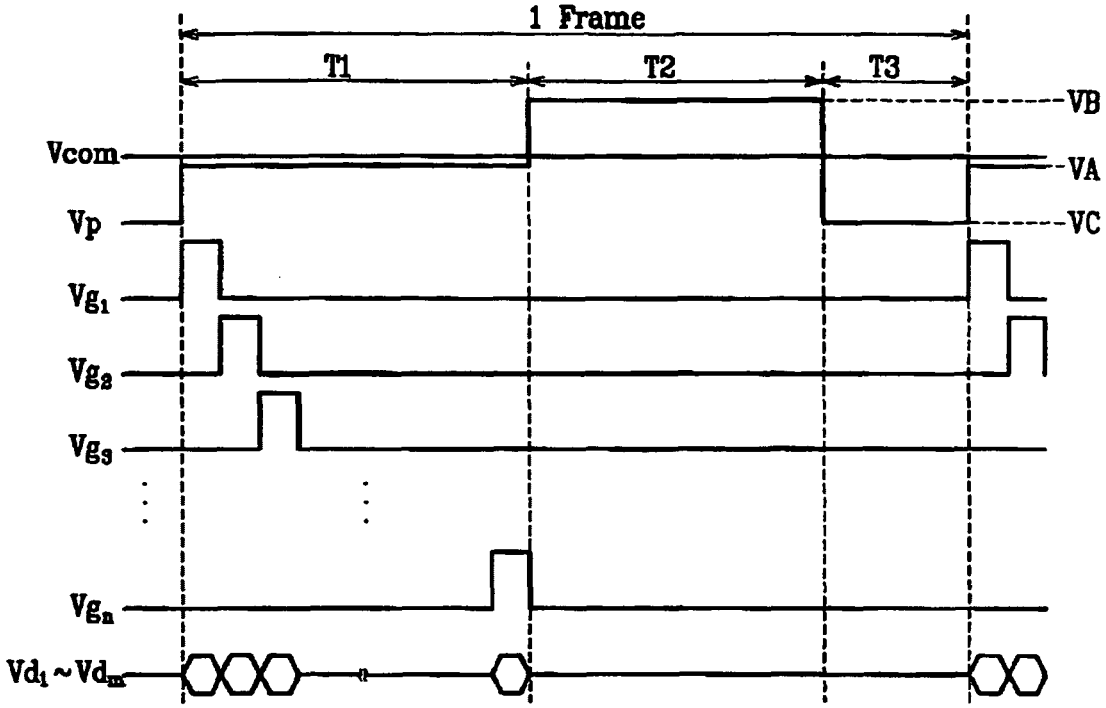
FIG. 4 is a timing chart illustrating several signals for an OLED according to an exemplary embodiment of the present invention.
Figure 5:
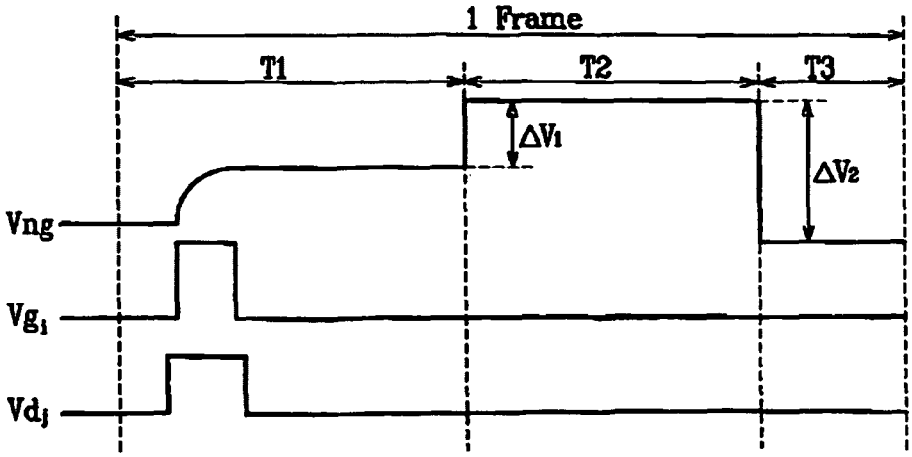
FIG. 5 illustrates waveforms of voltages at terminals of a driving transistor of an OLED according to an exemplary embodiment of the present invention.

FIG. 4 is a timing chart illustrating several signals for an OLED according to an exemplary embodiment of the present invention and FIG. 5 illustrates waveforms of voltages at terminals of the driving transistor Qd of an OLED according to an exemplary embodiment of the present invention.

The signal controller 600 is supplied with input image signals R, G and B and input control signals controlling a display of images. The input control signals include a vertical synchronization signal Vsync, a horizontal synchronization signal Hsync, a main clock MCLK, and a data enable signal DE, from an external graphics controller (not shown). After generating scanning control signals CONT1, data control signals CONT2, and emission control signals CONT3 and processing the image signals R, G and B suitable for operation of the display panel 300 responsive to the input control signals and the input image signals R, G and B, the signal controller 600 sends the scanning control signals CONT1 to the scanning driver 400, the processed image signals DAT and the data control signals CONT2 to the data driver 500, and the emission control signals CONT3 to the driving signal generator 700.

The scanning control signals CONT1 include a scanning start signal STV for instructing the scanning driver 400 to start scanning and at least one clock signal for controlling the output time of the gate-on voltage Von. The scanning control signals CONT1 may include a plurality of output enable signals for defining the duration of the gate-on voltage Von.

The data control signals CONT2 include a horizontal synchronization start signal STH for informing the data driver 500 of a start of data transmission for a group of pixels PX, a load signal LOAD for instructing the data driver 500 to apply the data voltages $Vd_1$-$Vd_m$ to the data lines $D_1$-$D_m$, and a data clock signal HCLK.

Responsive to the scanning, data and emission control signals CONT1-CONT3, the scanning driver 400, the data driver 500, and the driving signal generator 700 apply signals to the display panel 300. Application of the signals to the display panel 300 repeats every frame and each frame is divided into a writing period T1, an emission period T2, and a recovery period T3. The driving voltage signal Vp has a different value during each one of the writing period T1, the emission period T2, and the recovery period T3.

Writing Period (T1)

During the writing period T1, the driving signal generator 700 changes the driving voltage signal Vp to the middle level voltage VA to turn off the driving transistor Qd in response to the emission control signal CONT3 from the signal controller 600. The middle level voltage VA is preferably equal to or less than the common voltage Vcom applied to the cathode of the light emitting element LD, for example, the middle level voltage VA ranges from about −10V to about 0V. Although in this exemplary embodiment, it is assumed that the common voltage Vcom and the middle level voltage VA are equal to 0V, neither the common voltage Vcom nor the middle level voltage VA should be construed as being limited to a particular value.

The data driver 500 receives image data for a group of pixels PX, for example, the i-th pixel row from the signal controller 600, converts the image data into analog data voltages $Vd_1$-$Vd_m$, and applies the data voltages $Vd_1$-$Vd_m$ to the data lines $D_1$-$D_m$ in response to the data control signals CONT2 from the signal controller 600.

The scanning driver 400 makes a scanning signal $Vg_i$ for the i-th scanning signal line $G_i$ equal to the gate-on voltage Von in response to the scanning control signal CONT1 from the signal controller 600, thereby turning on the switching transistor Qs connected to the i-th scanning signal line $G_i$. The data voltages $Vd_1$-$Vd_m$ applied to the data lines $D_1$-$D_m$ are supplied to the control terminals Ng of the driving transistor Qd and the first and second capacitors Cs and Cd through the switching transistor Qs. The first and second capacitors Cs and Cd charge to the data voltages $Vd_1$-$Vd_m$.

By repeating the procedure above during each horizontal period (which is denoted by "1H" and equal to one period of the horizontal synchronization signal Hsync and the data enable signal DE), all scanning lines $G_1$-$G_n$ are sequentially supplied with the gate-on voltage Von during the writing period T1, thereby applying the data voltages $Vd_1$-$Vd_m$ to all corresponding pixels PX sequentially.

Since voltages stored in the first and second capacitors Cs and Cd are maintained during the writing period T1 even though scanning signals $Vg_1$-$Vg_n$ become the gate-off voltage Voff to turn off the switching transistor Qs, control terminal voltage Vng at the control terminal Ng of the driving transistors Qd is maintained.

However, since the driving voltage signal Vp is equal to or less than the common voltage Vcom during the writing period T1, as described above, voltage at the anode of the light emitting element LD is equal to or less than voltage at the cathode of the light emitting element LD even if the driving transistor Qd turns on. Therefore, the light emitting element LD does not pass the output current $I_{LD}$ and thus the light emitting element LD does not emit light. As a result, in the writing period T1, the light emitting element LD does not emit light although the data voltages $Vd_1$-$Vd_m$ are written to each pixel PX.

Emission Period (T2)

After the data voltages $Vd_1$-$Vd_m$ are written in all pixels PX, the emission period T2 starts when the driving signal generator 700 changes the driving voltage signal Vp to the high level voltage VB to turn on the driving transistor Qd in response to the emission control signal CONT3 from the signal controller 600. The high level voltage VB is preferably equal to about 20V, but is not limited to a particular value. The emission period T2 may begin after a predetermined period elapses after completion of writing of the data voltages $Vd_1$-$Vd_m$ to the pixels PX.

In response to a voltage level of the driving voltage signal Vp increasing, voltage at the anode of the light emitting element LD becomes higher than voltage at the cathode of the light emitting element LD such that the output current $I_{LD}$ starts to flow through the light emitting element LD. Magnitude of the output current $I_{LD}$ depends on the voltage Vgs between the control terminal Ng and the output terminal Ns of the driving transistor Qd. The OLED displays images by controlling the magnitude of the output current $I_{LD}$ for each light emitting element LD of the panel display 300.

In response to variation in the driving voltage signal Vp, the control terminal voltage Vng varies due to the capacitive coupling with the driving voltage signal Vp through the first and second capacitors Cs and Cd. A first voltage variation ΔV1 of the control terminal Ng of the driving transistor Qd is given by equation (1) below:

$$\Delta V1 = \frac{Cd}{(Cd + Cs)} \times \Delta Vp = \frac{Cd}{(Cd + Cs)} \times (VB - VA) \quad (1)$$

Accordingly, the control terminal voltage Vng has a level equal to a sum of a voltage level of the control terminal voltage Vng right before the emission period T2 starts and the first voltage variation ΔV1. Thus, the driving transistor Qd is driven by a voltage higher than the data voltage $Vd_1$-$Vd_m$ to increase the output current $I_{LD}$, thereby increasing a luminance of the light emitting element LD.

Recovery Period (T3)

The recovery period T3 begins when the driving signal generator 700 drops the driving voltage signal Vp down to the low level voltage VC. The low level voltage VC is preferably equal to −20V, but is not limited to a particular value. The voltage change of the driving voltage signal Vp also causes the change of the control terminal voltage Vng due to the capacitive coupling. A second voltage variation ΔV2 of the control terminal Ng of the driving transistor Qd is given by equation (2) below:

$$\Delta V2 = \frac{Cd}{(Cd + Cs)} \times \Delta Vp = \frac{Cd}{(Cd + Cs)} \times (VC - VB) \quad (2)$$

Accordingly, the control terminal voltage Vng has a level equal to a sum of a voltage level of the control terminal voltage Vng during the emission period T2 and the second voltage variation ΔV2. As shown in equation (2), the second voltage variation ΔV2 is negative and thus, the control terminal voltage Vng has a negative value during the recovery period T3. Thus, during the recovery period T3, there is no output current $I_{LD}$ through the light emitting element LD and the light emitting element LD does not emit light.

Since the control terminal Ng of the driving transistor Qd is negatively biased or reverse biased, degradation of a performance of the driving transistor Qd is reduced due to less deterioration of bias stress stability.

A duration of the writing, emission and recovery periods T1, T2 and T3 in one frame can be varied. For example, the emission period T2 during which the light emitting element LD emits light may be established to be equal in duration to the writing and recovery periods T1 and T3 during which the light emitting element LD does not emit light. A duration of the recovery period T3 is selected to reduce the degradation of the performance of the driving transistor Qd by applying to the reverse bias.

Additionally, mixture of the above-described two periods, i.e., a period having light emission and a period without light emission, provides impulsive driving that can reduce image drag of moving images.

The driving voltage signal Vp may have various values other than the above-described values. In addition, one frame may be divided into various number of periods, for example, two periods, three periods, or more than three periods. For example, a two period division may be realized by simultaneously writing data and emitting light and thereafter, providing the reverse bias. An example of three or more periods is that each of the writing, emission and recovery periods T1, T2 and T3 is divided into parts.

As described above, the driving voltage signal Vp applied to the input terminal Nd of the driving transistor Qd is varied and this variation is transmitted to the control terminal Ng of the driving transistor Qd by capacitive coupling. Accordingly, the driving transistor Qd can be driven by a voltage higher than the data voltage supplied from the data driver 500 such that the luminance of the light emitting element LD is increased.

In addition, since one frame is divided into the writing, emission period, and recovery periods T1, T2 and T3 for reverse biasing the driving transistor Qd, the degradation of the performance of the driving transistor Qd can be improved.

Although preferred embodiments of the present invention have been described in detail above, it should be clearly understood that many variations and/or modifications of the basic inventive concepts taught herein which may appear to those skilled in the present art will still fall within the spirit and scope of the present invention, as defined in the appended claims.

What is claimed is:

1. A display device comprising:

a light emitting element;

a switching transistor which transmits a data signal in response to a scanning signal;

a driving transistor having an input terminal directly electrically connected to a driving signal line, a control terminal directly connected to a source or a drain of the switching transistor, and an output terminal directly connected to the light emitting element, the driving transistor configured to supply a current to the light emitting element in response to an output signal of the switching transistor and a driving signal of the driving signal line; and a first capacitor directly connected between the control terminal of the driving transistor and the driving signal line; and a second capacitor having a first terminal connected directly to the light emitting element and a second terminal connected directly to the control terminal of the driving transistor, wherein the first and the second capacitors transmit a voltage depending on the driving signal and capacitances of the first capacitor and the second capacitor to the control terminal of the driving transistor, a single display frame is divided into three periods comprising a first period for writing data voltages, a second period for emitting light, followed by a third period for applying a reverse biasing voltage, the driving signal includes a first voltage level which turns off the driving transistor in the first period, a second voltage level which turns on the driving transistor in the second period and a third voltage level less than the first voltage level and applied in the third period, and the third voltage level applies a negative biased voltage to the control terminal of the driving transistor and the voltage of the control terminal of the driving transistor during the second period and the third period varies based on capacitive coupling of the first and second capacitors and the driving signal.

2. The display device of claim 1, wherein the first capacitor is electrically connected between the control terminal and the input terminal of the driving transistor, and the second capacitor is electrically connected between the control terminal and the output terminal of the driving transistor.

3. The display device of claim 2, wherein the switching transistor and the driving transistor comprise amorphous silicon.

4. The display device of claim 1, wherein the switching transistor and the driving transistor comprise NMOS thin film transistors.

5. A display device comprising:

a switching transistor;

a plurality of pixels, each pixel of the plurality of pixels including a light emitting element and a driving transistor which supplies current to the light emitting element, the driving transistor having an input terminal directly electrically connected to a driving signal line, a control terminal directly connected to a source or a drain of the switching transistor, and an output terminal directly connected to the light emitting element;

a signal controller which divides a single display frame into a first period for writing data voltages, a second period for emitting light and a third period for applying a reverse biasing voltage and which generates a control signal to control a duration of each of the first, second and third periods; and a driving signal generator which supplies a driving signal in response to the control signal from the signal controller, the driving signal having three or more voltage levels that are different from each other, wherein data voltages are written to each pixel during the first period, the driving transistor supplies current to the light emitting element to emit light based on data signals during the second period, the driving transistor is supplied with a reverse bias during the third period, a terminal of the light emitting element has a substantially fixed voltage, the driving signal includes a first voltage level which turns off the driving transistor during the first period, a second voltage level which turns on the driving transistor during the second period and a third voltage level which is less than the first voltage level and which is applied during the third period, and the third voltage level applies a negative biased voltage to the control terminal of the driving transistor and the voltage of the control terminal of the driving transistor during the second period and the third period varies based on capacitive coupling of a first capacitor, which is directly connected between the control terminal of the driving transistor and the driving signal line, and a second capacitor, which includes a first terminal connected directly to the light emitting element and a second terminal connected directly to the control terminal of the driving transistor, and the driving signal.

6. The display device of claim 5, further comprising a data driver for writing the data signals to each pixel.

7. The display device of claim 6, wherein the light emitting element emits light responsive to the current supplied by the driving transistor.

8. The display device of claim 7, wherein a luminance of light emitted by the light emitting element varies in response to an amount of the current supplied by the driving transistor.

9. The display device of claim 8, wherein the second period is subsequent and adjacent to the first period, and the third period is subsequent and adjacent to the second period.

* * * * *